United States Patent [19]

Gryctko

[11] 4,038,618

[45] July 26, 1977

[54] CIRCUIT BREAKER HAVING THERMAL AND SOLID STATE TRIP MEANS

[75] Inventor: Carl E. Gryctko, Bellefontaine, Ohio

[73] Assignee: I-T-E Imperial Corporation, Spring House, Pa.

[21] Appl. No.: 675,968

[22] Filed: Apr. 12, 1976

[51] Int. Cl.[2] ..... H01H 73/00; H01H 73/48

[52] U.S. Cl. ..... 335/23; 335/43; 335/172; 337/70; 361/115

[58] Field of Search ..... 335/23, 6, 25, 39, 43, 335/172; 337/70; 317/36 TD, 58; 200/148 G

[56] References Cited

U.S. PATENT DOCUMENTS

| | | | |
|---|---|---|---|
| 2,955,182 | 10/1960 | Caswell et al. | 200/148 G |
| 3,636,410 | 1/1972 | Pardini | 317/36 TD |
| 3,826,951 | 1/1973 | Mater et al. | 335/172 |

*Primary Examiner*—Harold Broome

*Attorney, Agent, or Firm*—Ostrolenk, Faber, Gerb & Soffen

[57] ABSTRACT

A molded case multi-pole circuit breaker is provided with a solid state trip unit constructed to automatically open the breaker responsive to predetermined fault current conditions. In addition, a bimetal actuated device sensitive to air temperature within the breaker housing is provided for automatically opening the breaker when air temperature within the housing exceeds a predetermined level.

6 Claims, 5 Drawing Figures

241
243
240
242
57
20
35
36
23
26
24
27
28
25
34
21
29
37
38
41
39
22
31
50
48
49
44
42
57
46
32
63
216
110
51
43
62
212
213
61
214
211
65
210
59
64
33
71

CIRCUIT BREAKER HAVING THERMAL AND SOLID STATE TRIP MEANS

This invention relates to molded case multi-pole circuit breakers in general an more particularly relates to breakers of this type having solid state trip units.

Typically, multi-pole molded case circuit breakers are provided with thermal-magnetic trip means that operate on the occurence of predetermined fault current conditions in any of the poles to automatically open the contacts in all poles of the circuit breaker. In breakers of this type having relatively high continuous current carrying capacity, say in excess of 800 amps, the trip units of the individual poles are part of a removable and replaceable sub-assembly.

In order for a circuit breaker to provide maximum protection for a given load without tripping falsely, its tripping characteristics must be tailored to withstandability of the load against damage due to overheating and electromagnetic effects. With prior art thermal-magnetic trip units only a limited range of factory calibration and user adjustments are possible so that it is necessary for a supplier to carry many different trip units.

It has been known for some time that trip units utilizing solid state circuitry are more readily adjusted over a wider range of characteristics than are conventional magnetic trip units. In addition, solid state trip units achieve greater accuracy and repeatability, and with relatively simple adjustments obtain more complex time versus current characteristics. One such solid state trip unit is disclosed in the G. Gaskill co-pending application Ser. No. 671,077, filed Mar. 29, 1976, and assigned to the assignee of the instant invention, as well as on other applications referred to in said application Ser. No. 671,077.

However, solid state trip units are insensitive to heating of the circuit breaker and as a result even though a dangerous overheating condition exists the breaker will not open unless overheating is a result of a fault current condition. Overheating of this type may occur when there is a poor electrical connection within the circuit breaker housing. This results in a high resistance joint where overheating takes place even though currents are kept within the operating range of the breaker.

Accordingly, in accordance with the instant invention a circuit breaker is provided with a solid state trip means and is also provided with a thermal trip device that is sensitive to the air temperature within the housing and operates to open the breaker when this air temperature exceeds a predetermined temperature.

Accordingly, a primary object of the instant invention is to provide a novel construction for a multi-pole circuit having a solid state automatic trip means.

Another object is to provide a circuit breaker of this type also having a thermal trip means.

Still another object is to provide a circuit breaker of this type in which the thermal trip means is sensitive to temperature.

These objects as well as other objects of this invention shall become readily apparent after reading the following description of the accompanying drawings in which.

Figures 1, 5:
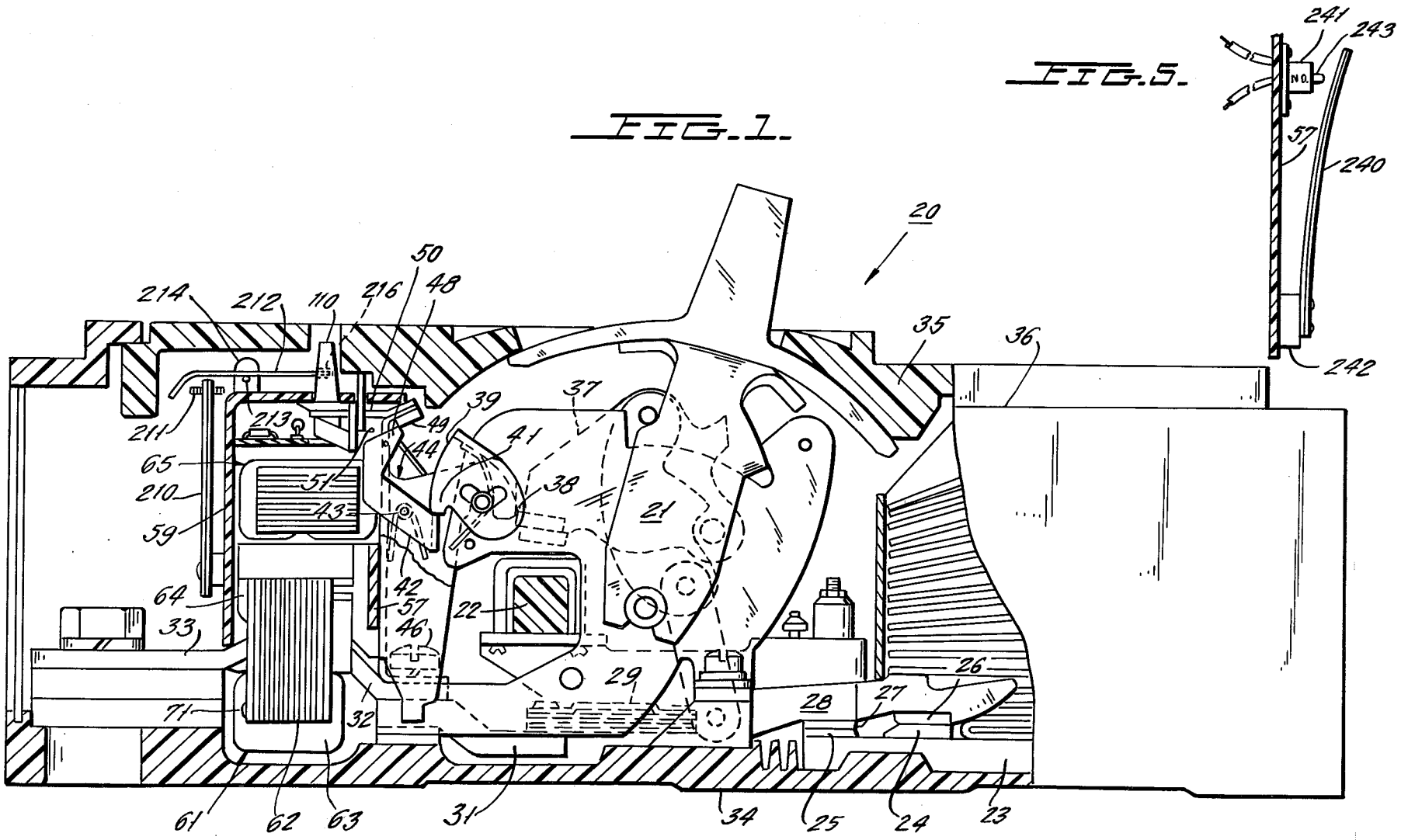
FIG. 1 is a longitudinal cross-section of a multi-pole circuit breaker incorporating a solid state trip and thermal means constructed in accordance with the teachings of the instant invention.
FIG. 5 is a fragmentary side elevation and showning another embodiment of the instant invention.

Now referring to Figures. Molded case circuit breaker 20 of FIG. 1 is a three pole unit with a common spring powered contact operating mechanism 21 all disposed with a molded insulating housing consisting of base 34 and cover 35 which is separable from 34 at line 36. Transverse insulating bar 22 provides a mechanical tie between the movable current carrying element of all three poles for simultaneous operation thereof in a manner well known to the art. The current carrying path through the center pole consists of line terminal member 23, stationary arcing and main contacts 24, 25, movable arcing and main contacts 26, 27, movable contact arms 28, flexible conductor 29, strap 31, and main bus section 32 which terminates in load terminal 33. Removable screws 46, extending through clearance apertures in the line ends of buses 32, provides contact pressure buses 32 and straps 31. The two outer poles of breaker 20 have essentially the same current elements as the center pole just described.

Contact operating mechanism 21 is a conventional trip free spring powered over center toggle unit including releaseable cradle 37 which is normally held in the reset position shown in FIG. 1 by latching portion 38 of auxiliary latch 39. At point 41 auxiliary latch 39 is held by engagement with main latch 42 which is pivotally mounted to support bracket 44 on pin 43. The end of main latch remote from point 41 is provided with nose 48 that is normally engaged by latching plate 49 on trip member 50. The latter is pivotally mounted to bracket 44 on pin 51.

As explained in detail in the aforesaid application Ser. No. 671,077, bracket 44 and the elements mounted thereto constitute a sub-assembly which together with all three main buses 32 are elements of removable and replaceable solid state trip unit 60 (FIG. 2) disposed within circuit breaker housing 34, 35 at the load end thereof. Unit 60 also includes a common insulating frame or housing consisting of member 58 having a U-shaped cross-section and member 59 having an L-shaped cross-section with the latter constituting a removable cover that is normally held in place by screws 45, 45. The web portion or wall 57 of member extends in a plane generally perpendicular to main conductors 32. The latter are positioned at the bottom of housing 58, 59, when viewed with respect to FIGS. 1-3, and extend beyond both the line and load sides of housing 58, 59. Bracket 44 and the elements mounted thereon constitute a sub-assembly mounted to frame member 58 with the major portion of bracket 44 abutting the line side of wall 57 with pivot 51 for trip member 50 being positioned at the upper end of wall 57.

Each main bus 32 constitutes a single turn primary for an individual input transformer 61 provided for each pole of the circuit breaker 20. Each input transformer 61 also includes square laminated magnetic frame or core 62 through which primary 32 extends. The multi-turn coils 63, 64 wound around opposite legs of core 62 and being connected in series aiding relationship. The output of secondary 63, 64 is fed through the multi-turn primary of output transformer 65 whose secondary feeds the solid state control circuitry on circuit board 66. Output transformer 65 is provided with a square laminated magnetic frame or core 67 having coil means mounted on opposite legs thereof with each of these coil means consisting of a portion of the primary and a portion of the secondary for output transformer 65. These primary portions are connected in series aiding relationship as are these secondary portions. In total, the secondary of transformer 65 has many more turns than the primary.

Figure 3:
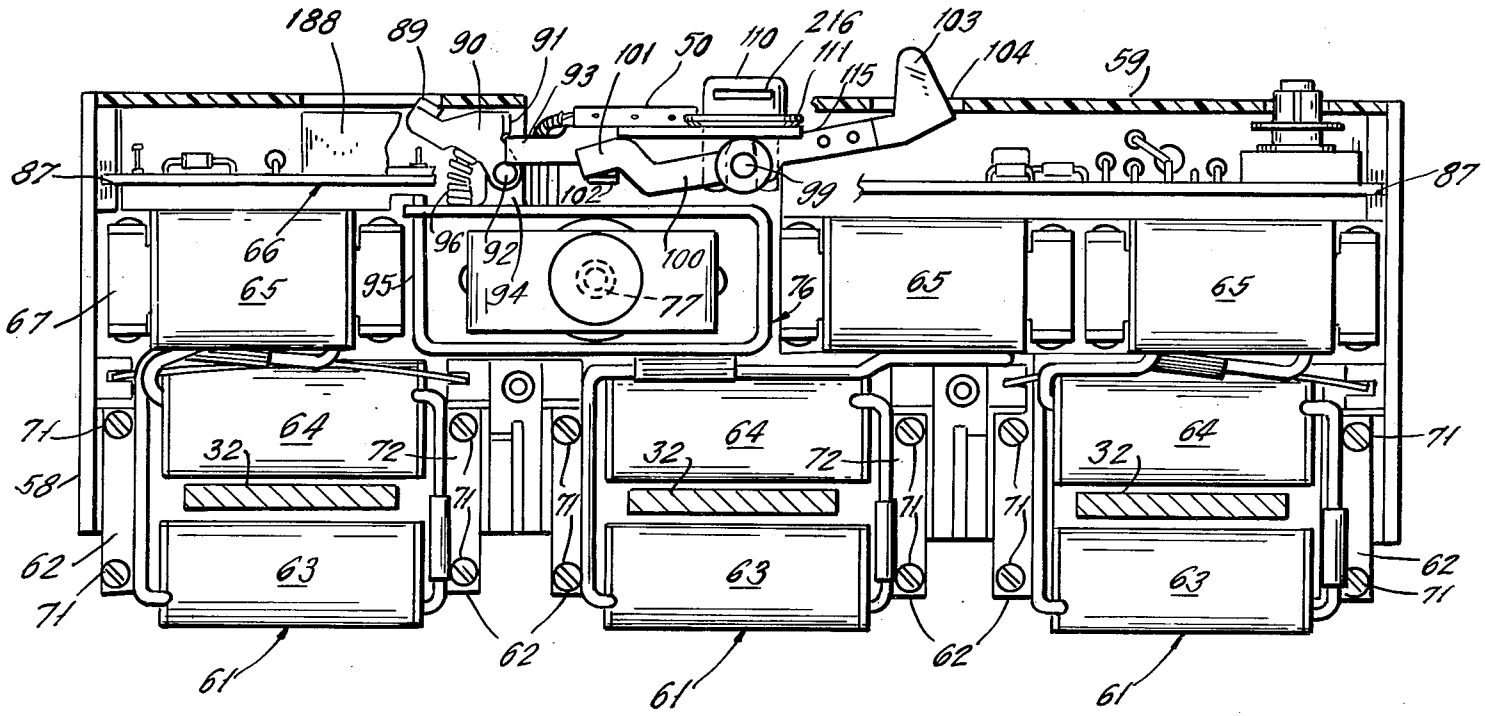
FIG. 3 is a load end view of trip means with the rear wall of the housing removed.

Circuit board 66 is mounted by sliding the short edges thereof in interior grooves 87 (FIG. 3) of frame member 58. As best seen in FIG. 3, all three input transformers 61 are arranged in a horizontal row below circuit board 66. Interposed between circuit board 66 and the row of transformer 61 is another horizontal row containing all three output transformers 65 together with permanent magnet latch 76. The latter is described in detail in the G. Gaskill copending application Ser. No. 656,108, filed Feb. 9, 1976 for an Improved Magnetic Latch Construction, and assigned to the assignee of the instant invention. Latch 76 includes actuator 77 biased to the right with respect to FIG. 1 and normally held in a retracted position against its biasing force by a permanent magnet (not shown). In a manner known to the art, plunger 77 is released by the permanent magnet when flux generated by the latter is bucked by a flux field resulting from an output signal generated by the control circuitry of board 66 when predetermined fault current conditions exist at one or more of the main buses 32. The construction and operation of the control circuit is illustrated and described in the L. Davis and P. Pang copending application Ser. No. 658,354, filed Feb. 17, 1976 for a Solid State Tripping Circuit, and assigned to the assignee of the instant invention.

When actuator 77 is released and moves to the right with respect to FIG. 1 it pivots tripping member 50 in a counterclockwise direction. This releases nose 48 of main latch 42 from latch plate 49 permitting main latch 42 to pivot clockwise about pin 43 thereby releasing auxiliary latch 39 so that cradle 37 is free to move to its trip position under the influence of the main operating springs of contact operating mechanism 21.

Cover interlock unit 100 is mounted near its center on pivot 99 and is biased counterclockwise with respect to FIG. 3 by a torsion spring wound about pivot 99 so that end 101 engages projection 102 of trip member 50 to move member 50 counterclockwise with respect to FIG. 1 to its tripping position. The end of member 100 remote from end 101 is provided with upwardly extending nose 103 that projects through clearance slot 104 in cover 59 of trip unit housing 58, 59. As the circuit breaker housing cover 35 is mounted to base 34, the inside surface of cover 35 engages nose 103 to move the latter from the position thereof shown in FIG. 3. This pivots cover interlock 100 clockwise with respect to FIG. 3 so that end 101 is raised to a position such that trip member 50 may move clockwise with respect to FIG. 1 to a position wherein latch plate 49 holds latch 42 in latching position. When cover 35, or a removable portion thereof (not shown) aligned with nose 103, is opened, unit 100 pivots counterclockwise thereby operating trip member 50 counterclockwise with respect to FIG. 1 to release latch 42.

Circuit board 66 includes rating plug 88, frictionally held in socket 188 and including one or more of the elements such as a resistor or capacitor, which determines operation of the electronic processing circuitry 200 of board 66. When operatively positioned on board 66, plug 88 engages ear 89 of plug interlock or lockout member 90 to pivot counterclockwise with respect to FIG. 3 about rivet 92 as a center so that latching ear 91 of member 900 moves clear of extension 93 on trip member 50. Rivet 92 extends through ear 94 which projects upward from shield housing 95 of permanent magnet latch 76. Coiled compression spring 96 is interposed between shield 95 and member 90 so that when rating plug 88 is removed member 90 pivots clockwise to its position of FIG. 3 with ear 91 thereof engaging extension 93 causing trip member 50 to remain in the tripped position to which it had previously been moved by cover interlock unit 100.

It is noted that while the torsion biasing spring for cover interlock 100 is strong enough to trip breaker 20, rating plug interlock spring 96 is not strong enough to trip breaker 20. However, spring 96 is strong enough to hold trip member 50 in tripped position once it has been operated thereto by cover interlock unit 100. Thus, cover interlock 100 is a tripping device while rating plug interlock 90 is a latching device.

Manually operable trip member 110 projects upward through aperture 116 in trip unit housing cover 59. The lower end of member 110 is bifurcated and straddles pin 99 which acts to guide member 110 as it is being depressed. Flange 111 of member 110 is disposed inside of trip unit housing 58, 59 and is supported on trip member extension 115 so that when member 110 is depressed trip member 50 is pivoted counterclockwise about pin 51 with respect to FIG. 1 to release nose 48 of main latch 42 from latch plate 49 thereby tripping operating mechanism 21.

Figure 2:
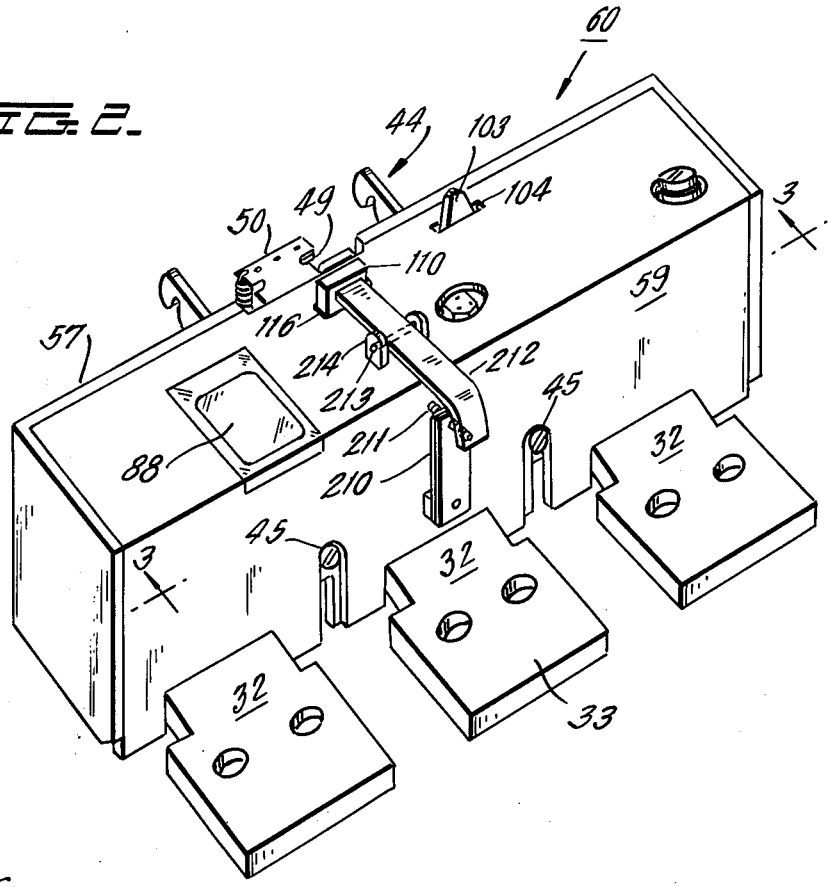
FIG. 2 is a perspective of the solid state and thermal trip means, looking toward the load end thereof.

As seen in FIGS. 1 and 2 circuit breaker 20 also includes bimetal strip 210 having its lower end rigidly secured to insulating standoff 211 affixed to the vertical wall of cover 59 on the load side thereof. Upon heating of bimetal 210, the upper end thereof is free to deflect to the left with respect to FIG. 1 with adjusting screw 211 carried thereby engaging the downwardly curved left end of lever 212. The latter is pivotally mounted on pin 213 that extends between the walls of U-shaped bracket 214. The web of bracket 214 is secured to the horizontal surface of cover 59 in such a position that with cover 59 mounted to frame 58 the right end of lever 212 extends into depressing 216 (FIG. 3) of manually operable trip member 110.

Thus, as the temperature of bimetal 210 rises the upper end thereof deflects to the left with respect to FIG. 1 so that adjustment screw 211 engages lever 212 pivoting the latter clockwise. This moves the right end of lever 212 downward depressing control 110 thereby pivoting trip member counterclockwise for tripping of operating mechanism 20 in a manner previously described. It is noted that heating of bimetal 210 is essentially limited to connection in that bimetal 210 is not a current carrying element and the mounting thereof is intended to insulate same from conduction of heat developed in the current carrying elements of circuit breaker 20.

Figure 4:
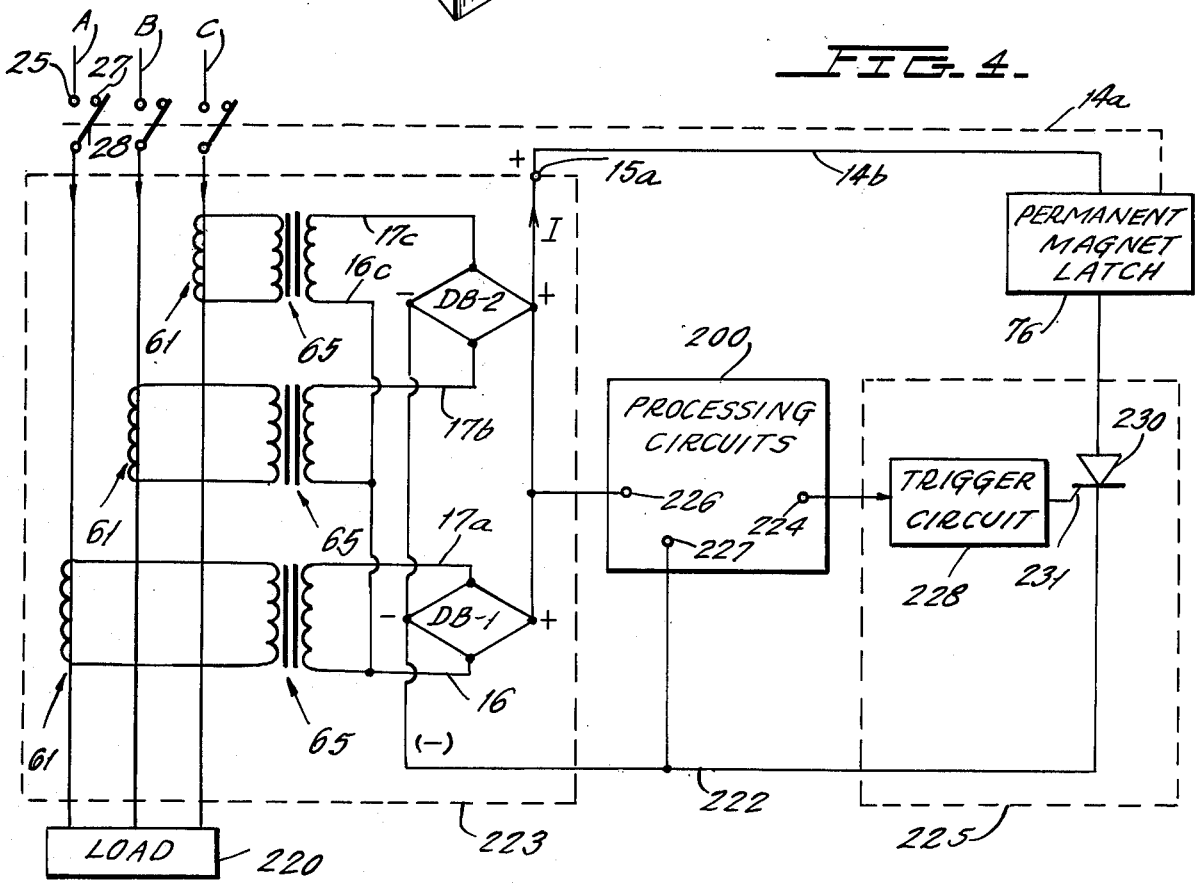
FIG. 4 is a diagram of the solid state trip means.

FIG. 4 is a simplified diagram showing the solid state tripping circuitry of the aforesaid co-pending application Ser. No. 658,354 in relation to elements of a circuit in which circuit breaker 20 is connected. More particularly, the three poles of circuit breaker 20 are shown as being interposed between load 220 and lines A, B, C from a three phase power source. The secondary windings of output transformers 65 are connected to diode bridge units DB-1 and DB-2 which produce signals between positive and negative buses 221, 222 related to currents flowing through breaker 20. Thus, input transformers 61, output transformers 65 and diode bridges DB-1 and DB-2 constitute a means 223 which monitors the current through breaker 20.

The output of monitoring means 223 is applied across input terminals 226, 227 of processing circuits 200 which analyze the character of signal supplied at terminals 226, 227 and upon detecting that predetermined fault current conditions to exist in breaker 20, produce an output at terminal 224 which actuates trigger circuit 228. The latter is part of latch releasing mean 225 which includes controlled rectifier 230 whose switching input 231 is under the control of trigger circuit 228. The anode-cathode circuit of rectifier 230 is in series with the operating or bucking coil of permanent magnet latch 76.

Normally rectifier 230 is non conducting. However, when trigger circuit 228 is actuated, a signal is provided at switching input 231 to trigger rectifier 230 into conduction. This energizes the operating coil of permanent magnet latch 76 for operation thereof to trip circuit breaker 20 thereby moving contact arm means 28 in all poles thereof to open circuit position.

In another embodiment of this invention, illustrated in FIG. 5, bimetal 210 and lever 212 are replaced by bimetal 240 and normally open microswitch 241 both secured to the line side of frame wall 57. Bimetal 240 extends vertically, with the lower end thereof being fixedly secured to insulating standoff 242 which is interposed between bimetal 240 and wall 57. When bimetal 240 is heated, the upper end thereof is free to deflect to the left with respect to FIG. 5 and engage microswitch actuator 243 to close switch 241. The latter is connected in parallel with the anode-diode circuit of controlled rectifier 240 so that when switch 241 is closed the operating coil of permanent magnet latch 76 is engerized to cause tripping of circuit 20.

Thus, it is seen that the instant invention provides means for automatically tripping a molded case circuit breaker, having a solid state trip, responsive to detection of abnormally high temperatures within the case. Means provided by the instant invention acts independently of the processing circuitry of the solid state trip, and is capable of detecting and responding to high temperatures generated, for instance, by loose electrical connections or deteriation of contacts.

While only a single bimetal 240 and associated microswitch 241 have been illustrated, it should now be apparent to those skilled in the art that a plurality of bimetals and associated microswitches may be provided at different locations within circuit breaker housing 34, 35, in which event the microswitches will be connected in parallel with one another and will shunt the anode-cathode circuit of controlled rectifier 230 so that closing of any of these switches will cause tripping of circuit breaker 20. Further, the bimetal, or other heat responsive element, may be disposed within the trip unit housing, thereby being more sensitive to abnormal heating with the trip unit housing.

Although there has been describe preferred embodiments of this invention, many variations and modifications will now be apparent to those skilled in the art. Therefore, this invention is not to be limited by the specific disclosure herein, but only by the appended claims.

What is claimed is:

1. A circuit breaker including cooperating contact means; an operating mechanism operatively connected to said contact means: a latch means normally maintaining and said mechanism latched in position for opening and closing said contact means; solid state trip means having a first portion for monitoring currents flowing in said breaker, a second portion for processing signals generated by said first portion, and a third portion for releasing said latch means to automatically trip said mechanism thereby opening said contact means responsive to a trip signal generated by said portion when predetermined overload currents flow in said breaker; a housing wherein said contact means, said operating mechanism, said latch means and said trip means are disposed; a thermally responsive first means disposed within said housing and insulated from electrical and thermal conduction with current carrying elements in said housing whereby temperature of said first means is essentially a function of air temperature within said housing; and second means operatively connecting said first means with said latch means whereby the latter will release said latch means when said first means is subjected to predetermined conditions of temperature.

2. A circuit breaker as set forth in claim 1 in which the first means is a bimetal device.

3. A circuit breaker as set forth in claim 1 in which the second means acts through said third portion to release said latch means.

4. A circuit breaker as set forth in claim 3 in which the first means is a bimetal device.

5. A circuit breaker as set forth in claim 1 in which the second means bypasses said trip means and acts mechanically on said latch means to release the latter.

6. A circuit breaker as set forth in claim 5 in which the first means is a bimetal device.

* * * * *